US006125252A

United States Patent [19]

Thompson et al.

[11] Patent Number: 6,125,252

[45] Date of Patent: Sep. 26, 2000

[54] ADJUSTMENT SETUP MECHANISM FOR SUPPORT RAILS OF A DEVELOPMENT STATION FOR A REPRODUCTION APPARATUS

[76] Inventors: Paul E. Thompson; Christopher S. Garcia; Charles R. Winterberger, all of Eastman Kodak Company 343 State St., Rochester, N.Y. 14650

[21] Appl. No.: 09/218,509

[22] Filed: Dec. 22, 1998

[51] Int. Cl.[7] ..... G03G 21/00

[52] U.S. Cl. ..... 399/126; 399/119

[58] Field of Search ..... 399/126, 119, 399/262, 252, 162–165

[56] References Cited

U.S. PATENT DOCUMENTS 4,097,139 6/1978 Hauser et al. .
4,887,132 12/1989 Joseph et al. .
4,963,936 10/1990 Carter .
5,132,732 7/1992 Kalyandurg et al. .

*Primary Examiner*—Richard Moses
*Attorney, Agent, or Firm*—Lawrence P. Kessler

[57] ABSTRACT

An adjustment mechanism for setting up spacing of a development station for a reproduction apparatus within a desired tolerance range such that marking particles from the development station properly develop electrostatic images. The adjustment mechanism includes a datum member and a cam having a locating post for the development station extending from the cam. The datum member includes, for example, a bracket in the reproduction apparatus, and at least one pin attached to the bracket. The cam is adjustably associated with the datum member so as to selectively position the locating post a predetermined distance from the datum member. The adjustable cam includes, for example, a member defining a plurality of spaced openings, the openings capable of receiving the at least one pin of the datum member so as to position the locating post dependent upon which opening the at least one pin is received within. Accordingly, location of the development station relative to the datum member may be set within a desired tolerance range.

8 Claims, 3 Drawing Sheets

ADJUSTMENT SETUP MECHANISM FOR SUPPORT RAILS OF A DEVELOPMENT STATION FOR A REPRODUCTION APPARATUS

FIELD OF THE INVENTION

This invention is directed in general to a development station for a reproduction apparatus, and more particularly to an adjustment mechanism for setting up support rails of a development station for a reproduction apparatus.

BACKGROUND OF THE INVENTION

Typical commercial reproduction apparatus include electrostatographic process copier/duplicators or printers, inkjet printers, and thermal printers. With such reproduction apparatus, pigmented marking particles, ink, or dye material (hereinafter referred to commonly as marking or toner particles) are utilized to develop an electrostatic image, of information to be reproduced, on a dielectric member for transfer to a receiver member, or directly onto a receiver member. The receiver member bearing the marking particle image is transported through a fuser device where the image is fixed (fused) to the receiver member, for example, by heat and pressure to form a permanent reproduction thereon.

Well known electrostatic developer apparatus for commercial reproduction apparatus may include a development station having a housing reservoir in which developer material, including pigmented marking particles, is located. A mechanism, such as a magnetic brush for example, receives developer material from the housing reservoir and transports such material to a position where part of such material is applied to an electrostatic image formed on the surface of the dielectric member to develop such image (see, for example, U.S. Pat. No. 4,887,132, issued Dec. 12, 19898, in the names of Joseph et al).

In setting up the development station for the reproduction apparatus, in order to assure proper development of electrostatic images on the dielectric member, it is necessary to accurately locate the spacing of the development station relative to plane of the dielectric member, within a specified tolerance range, over the zone of operative interrelation between the dielectric member and the development station. Typically the development station is mounted on a support that must be at a specified distance from the core which supports the dielectric member for movement about a closed loop path in operative relation with electrographic process stations. As the desired tolerance range is smaller than that which is generally achievable by normal mechanical operations, due in part to the parts tolerance stack up in the reproduction apparatus, it has been found that there is a need for a critical-to-function factory adjustment to properly set up the spacing of the dielectric member to the development station. Such adjustment is necessary in order to provide for proper operational setup, and must be made in such a way as to minimize the possibility of being inadvertently altered at some subsequent time, such as during shipping.

One current process for factory adjustment of the development station location relative to the dielectric member core involves drilling holes through a portion of the frame of the reproduction apparatus, into which locating pins are installed for mounting development station support rails. The holes are located by use of a drill jig that is adjusted to the appropriate distance from a reference on the dielectric member support core. However, with this process, it is very difficult to repair a hole that has been drilled in the wrong location. Such hole must be welded and then redrilled.

Furthermore, metal chips from the drilling operation contaminate the inside of the reproduction apparatus and can lead to damage of the dielectric member.

SUMMARY OF THE INVENTION

In view of the above, this invention is directed to an adjustment mechanism for setting up support rails of a development station for a reproduction apparatus. The adjustment mechanism includes a datum member and a cam having a locating post for the development station extending from the cam. The datum member includes, for example, a bracket in the reproduction apparatus, and at least one pin attached to the bracket. The cam is adjustably associated with the datum member so as to selectively position the locating post a predetermined distance from the datum member. The adjustable cam includes, for example, a member defining a plurality of spaced openings, the openings capable of receiving the at least one pin of the datum member so as to position the locating post dependent upon which opening the at least one pin is received within. Accordingly, location of the development station relative to the datum member may be set within a desired tolerance range.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
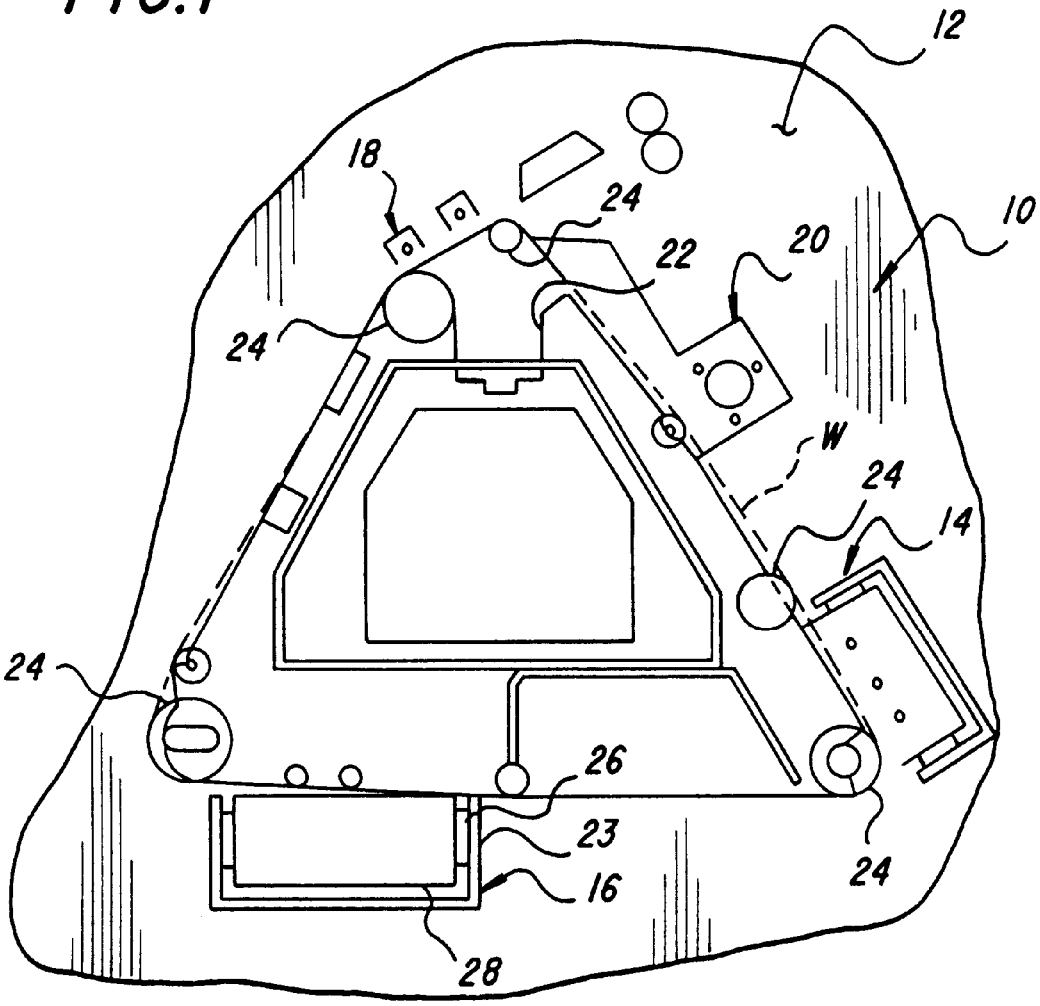
FIG. 1 is a front elevational view of a portion of the process area of a typical commercial reproduction apparatus, with elements broken away or removed to facilitate viewing.

Referring now to the accompanying drawings, FIG. 1 shows a portion of the interior of a typical commercial reproduction apparatus, designated generally by the numeral 10, in which an electrostatic image on a dielectric member W is developed with pigmented marking particles and then transferred and fused to a receiver member. The reproduction apparatus 10 includes a main machine frame 12 from which the various electrographic process elements and stations are mounted, substantially in a cantilever fashion. Such electrographic process elements and stations include a primary charger 14 for uniformly charging the dielectric member W, a development station 16 for developing an electrostatic image on the dielectric member with pigmented marking particles, a transfer station 18 for transferring the developed image from the dielectric member to a receiver member, and a cleaning station 20 for removing residual particles from the dielectric member prior to reuse of the dielectric member.

A core 22, for supporting a plurality of rollers 24, is also mounted on the machine frame 12. The rollers 24 support the dielectric member W, in the form of a continuous web, for movement about a closed loop path in operative relation with the electrographic process elements and stations. The location of the core 22 and the various electrographic process elements and stations are set at the machine frame 12 by accurately formed features (such as holes, slots or surfaces for example) so as to maintain such elements and stations in accurate positional interrelation with the core, and with each other. However, since the process elements and stations extend in cantilever fashion from the machine frame 12, the ends of the elements and stations remote from the machine frame may not be held within desired tolerance limits.

As noted above, one of the important positional interrelations for proper operation of the reproduction apparatus is the location of the development station 16 relative to the dielectric member W. Accurate interrelation therebetween is necessary in order for complete and full development of electrostatic images, carried by the dielectric member W, with pigmented marking particles from the development station. Accordingly, the development station 16 is made adjustable, in a manner according to this invention, at the end of the station remote from the machine frame 12 (see FIG. 2) to assure that the development station is within a desired tolerance range from the plane of the dielectric member supported on the core 22.

The development station 16 includes a bracket 23 mounted on the main machine frame 12. The bracket 23 supports a slide rail assembly 26. The slide rail assembly includes a pair of slide rails spaced apart a distance to accommodate a marking particle reservoir and applicator housing 28 (shown only in FIG. 1). The housing 28 is supported on the slide rail assembly for movement in a direction substantially perpendicular to the plane of the machine frame 12. As such the marking particle reservoir and applicator housing 28 is movable to a location in juxtaposition with the machine frame so as to be in operative relation with the dielectric member W, or to a location remote from the machine frame for easy access for ready repair or removal.

Figure 2:
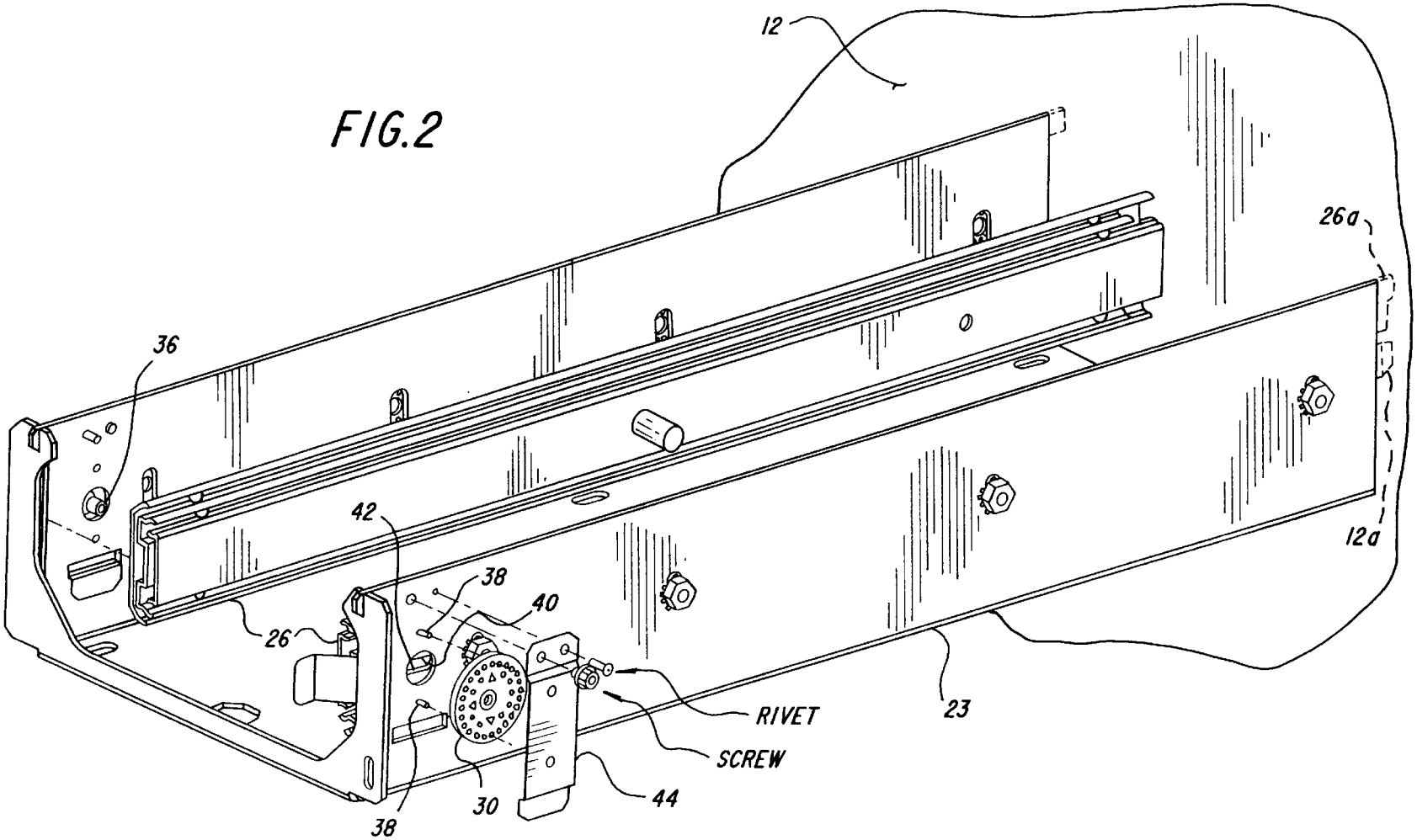
FIG. 2 is a view, in perspective, with portions removed to facilitate viewing, of the adjustment mechanism, according to this invention, for setting up support rails of a development station for a reproduction apparatus, the adjustment mechanism being shown in an exploded condition.
Figure 3:
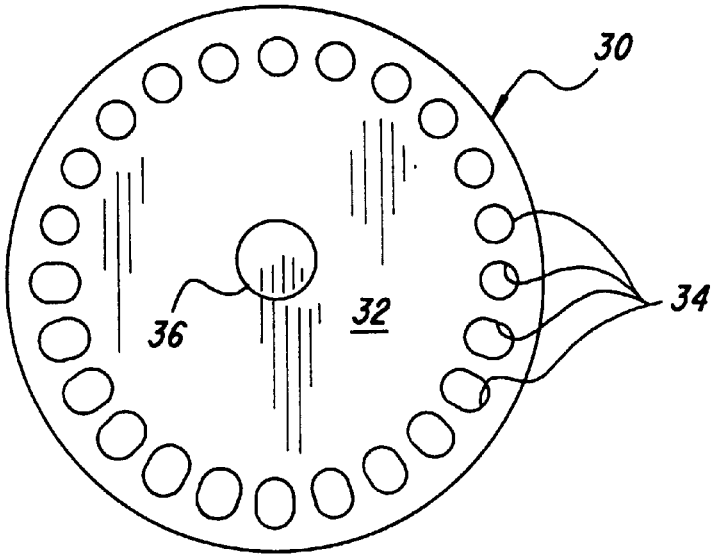
FIG. 3 is a front elevational view, on an enlarged scale, of the adjusting cam of the adjustment mechanism shown in FIG. 2.
Figure 4:
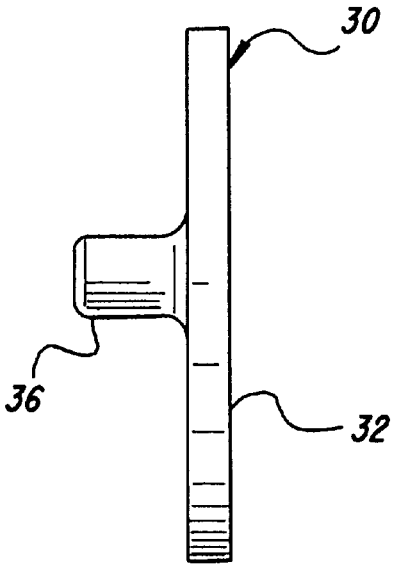
FIG. 4 is a side elevational view, of the adjusting cam shown in FIG. 3.

The ends 26*a* of the slide rails of the slide rail assembly 26, in juxtaposition with the machine frame 12, are supported by features 12*a* on the machine frame so that such ends are accurately located relative to the dielectric support core 22. The opposite ends 26*b* of the slide rails of the slide rail assembly 26 are adjustably supported by respective associated adjusting cams 30 (only one shown in FIG. 2). The adjusting cam 30, best shown in FIGS. 3 and 4, is the same for each slide rail, and as such only one cam is shown and described herein. The adjusting cam 30 includes a disc member 32. A series of openings 34 are defined through the disc member 32 adjacent to the perimeter thereof. A locating post 36 extends substantially perpendicularly from the disc member 32, and is positioned so that the axis of the post is eccentric with respect to the disc member.

Figure 5:
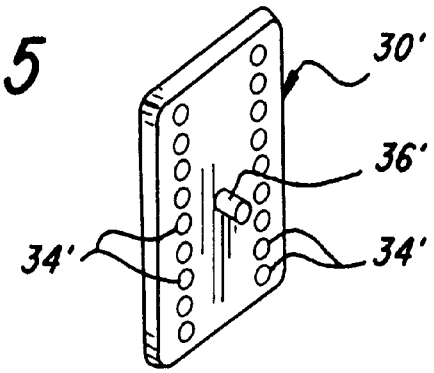
FIG. 5 is a view, in perspective and on an enlarged scale, of an alternate embodiment of the adjusting cam of the adjustment mechanism shown in FIG. 2.

Of course, alternate forms of the adjusting cam are suitable for use with this invention. As an example, an alternate configuration for the adjusting cam is shown in FIG. 5. Here the adjusting cam, designated generally by the numeral 30', is substantially rectangular, with openings 34' defined in parallel lines on opposite sides of the locating post 36'.

The adjusting cam 30 is mounted on pins 38 fixed to the bracket 23, with the locating post 36 extending through an opening 40 defined through a side wall of the bracket. The pins 38 provide a datum, and are received in selected openings of the series of openings 34 of the disc member 32 such that the locating post 36 is at a certain distance from the plane of the dielectric member W (when the dielectric member is mounted on the dielectric member support core 22). A measurement is taken to determine if such distance would place the development station reservoir and applicator housing 28, when in the slide rail assembly 26, within the desired spacing tolerance range to accomplish proper development of electrostatic images on the dielectric member with marking particles from the development station.

If the distance is not within the desired tolerance range, the adjusting cam 30 is removed from the pins 38, rotated in the appropriate direction, and placed back on the pins. Rotation of the adjusting cam 30 has the effect of changing the location of the locating post 36 by a predetermined distance from one opening to the next. Thus, rotation through a determined angle of rotation (over a calculated number of openings 34) will enable the location of the post 36 to be changed a corresponding distance to bring the distance of the locating post from the plane of the dielectric member W within the desired tolerance range.

Once the certain distance of the locating post 36 to the plane of the dielectric member W is set to be within the desired tolerance range, the slide rail assembly 26 is mounted in the bracket 23. That is, the ends 26*a* of the slide rails of the slide rail assembly are fixed in the machine frame fixture 12*a*, and the ends of the slide rails of the slide rail assembly remote from the machine frame are mounted on respective locating posts 36. As best shown in FIG. 2, the slide rails of the slide rail assembly 26 each define a slot 42 into which the locating post 36 of a respective adjustable cam 30 is received. With the locating post for each adjustable cam in the respective slot of the associated slide rail, the slide rail assembly 26 will be fully supported and properly positioned such that the development station reservoir and applicator housing 24 is properly and accurately located in operative relation to the dielectric member W.

After each of the slide rails of the slide rail assembly 26 have been mounted on the respective locating posts 36, the adjusting cams 30 may each be covered by a plate 44. The cover plate 44 is attached to the bracket 23 by any suitable fasteners. The cover plate 44 serves to protect the associated adjusting cam 30, and hold the adjusting cam in the selected position. If further adjustment of the location of the development station 16 is subsequently required over time, the cover plates 44 are easily removed such that the adjusting cams 30 are readily accessible for rotation and readjustment of the development station location.

The invention has been described in detail with particular reference to certain preferred embodiments thereof, but it will be understood that variations and modifications can be effected within the spirit and scope of the invention.

What is claimed is:

1. An adjustment mechanism for setting up spacing of a development station for a reproduction apparatus, supported in a slide rail assembly extending from a machine frame, from a dielectric member of such reproduction apparatus, supported on a core mounted on said machine frame, within a desired tolerance range such that marking particles from said development station properly develop electrostatic images carried by said dielectric member, said adjustment mechanism comprising:

a datum member; and a cam having a locating post for said slide rail assembly of said development station extending from said cam, said cam being adjustably associated with said datum member so as to selectively position said locating post a predetermined distance from said datum member, whereby location of said slide rail assembly of said development station relative to said datum member may be set within a desired tolerance range.

2. The adjustment mechanism according to claim 1 wherein said datum member includes a bracket in said reproduction apparatus attached in a given spatial relation to said support core for said dielectric member, and at least one pin attached to said bracket spatial relation to said dielectric member.

3. The adjustment mechanism according to claim 2 wherein said adjustable cam includes a member defining a plurality of spaced openings, said openings capable of receiving said at least one pin of said datum member so as to position said locating post dependent upon which opening said at least one pin is received within.

4. The adjustment mechanism according to claim 3 wherein said adjustable cam member includes a disc, said disc defining a series of openings through the disc adjacent to the perimeter thereof, and said locating post extends substantially perpendicularly from the disc and is located such that the axis of said locating post is eccentric with respect to said disc.

5. The adjustment mechanism according to claim 3 wherein said adjustable cam includes a plate, and said locating post extends substantially perpendicularly from said plate, wherein said plate defines a series of openings lying in parallel lines on opposite sides of said locating post.

6. The adjustment mechanism according to claim 3 wherein a cover is removably attached to said bracket to protect said cam and hold the adjusting cam in the selected position.

7. The adjustment mechanism according to claim 2 wherein said datum member includes two pins attached to said bracket, said pins being spaced apart so as to be received in openings on opposite sides of said locating post.

8. The adjustment mechanism according to claim 2 wherein said slide rail assembly includes a pair of slide rails respectively supporting opposite sides of said development station, and said adjustment mechanism includes a pair of datum members and a pair of adjustable cams associated with said pair of slide rails respectively.

* * * * *